United States Patent [19]

Hixson

[11] 4,000,634

[45] Jan. 4, 1977

[54] METHOD AND APPARATUS FOR FORMING A SHEAVE FROM A FLAT DISC OF METAL

[75] Inventor: Claude M. Hixson, Tulsa, Okla.

[73] Assignee: Don R. Hinderliter, Inc., Tulsa, Okla.

[22] Filed: May 5, 1975

[21] Appl. No.: 574,592

[52] U.S. Cl. ..... 72/69; 29/159 R; 72/110

[51] Int. Cl.[2] ..... B21H 1/04

[58] Field of Search ..... 72/69, 110; 29/159 R, 29/159.01

[56] References Cited

UNITED STATES PATENTS

| | | | |
|---|---|---|---|
| 3,273,366 | 9/1966 | Schuman | 72/69 |
| 3,517,541 | 6/1970 | Wagner | 29/159.01 |
| 3,738,139 | 6/1973 | Proops et al. | 72/69 |
| 3,835,282 | 9/1974 | Sass et al. | 72/69 |
| 3,893,818 | 7/1975 | Mickus | 29/159 |

FOREIGN PATENTS OR APPLICATIONS

| | | | |
|---|---|---|---|
| 2,107,049 | 8/1972 | Germany | 72/110 |

*Primary Examiner*—Lowell A. Larson
*Attorney, Agent, or Firm*—William S. Dorman

[57] ABSTRACT

A method and apparatus for forming a flat circular disc of metal having a central opening therein into a sheave of the type having an annular peripheral groove for receiving a wire line therein, the size and shape of said groove corresponding to the diameter of said wire line; the disc has two flat side portions separated by the width of said disc and an outer diameter slightly larger than the outer diameter of the sheave to be produced; the apparatus by which the method of the present invention is carried out includes a pair of rotatable holding members rotatable on a common horizontal axis, means for moving the holders axially relatively towards and away from each other whereby when the holders are moved axially towards each other, the holders will engage the disc therebetween; each holder is provided with a hub portion facing towards the other holder concentric with the common horizontal axis and adapted to be received in the central opening of said disc; a rotatable forming roller is rotatable on an axis substantially parallel with the common horizontal axis and movable in a direction substantially at right angles to the common horizontal axis and into contact with the outer periphery of said disc, the portion of said forming roller contacting the disc having a convex shape corresponding to the size and shape of said groove and contacting the disc on the outer periphery thereof at a position substantially equidistant from the flat side portions thereof; means are provided for rotating said rotatable holding members; means are provided for heating the flat side portions of said disc adjacent said periphery; and means are provided for urging said roller continuously against said periphery of said disc during the heating thereof until said roller forms said groove in the periphery of said disc.

10 Claims, 11 Drawing Figures

METHOD AND APPARATUS FOR FORMING A SHEAVE FROM A FLAT DISC OF METAL

BACKGROUND OF THE INVENTION

1. Field of the Invention

This invention relates to a method and apparatus for forming sheaves of the type having an annular peripheral groove for receiving a wire line therein; more particularly, this invention relates to the method of forming a sheave of the type referred to above from a flat circular disc by rotating, heating and forming said groove in the periphery of said disc.

2. The Prior Art

Sheaves of the type having a groove for receiving a wire line or rope therein have been manufactured heretofore in a number of different ways. Normally, this type of sheave can be made by casting the sheave including the groove and rim, in which case the product has to be machine finished. Occasionally, a sheave of this type will be forged, such as in a closed die forging; again, the forged product will be generally subjected to a final machining. It has also been known that a complete sheave can be machined from a plate of steel. Sometimes the sheave can be fabricated in sections by forming the groove as a straight piece, rolling the same into a hoop, butt welding the hoop and then welding the hoop to a disc of steel and hub or to spokes and hub; this fabricated product will also have to be machine finished. Certain types of pulleys have been manufactured in the past by splitting the peripheral edge with a sharp rotary knife blade. The prior art does not show or suggest the hot roll forming of a sheave from a flat disc of metal.

SUMMARY OF THE INVENTION

The present invention involves a method and apparatus for forming a sheave of the type having an annular peripheral groove for receiving a wire line therein from a flat circular disc of metal. The size and shape of the groove in the finally produced sheave will correspond to the diameter of the wire line. The disc has two flat side portions separated by the width of the disc and an outer diameter slightly larger than the other diameter of the sheave to be produced. The apparatus by which the present invention is carried out includes a pair of rotatable holding members rotatable on a common horizontal axis, means for moving the holders axially relatively towards and away from each other whereby, when the holders are moved towards each other, they will engage the disc between them. Each holder is provided with a hub portion facing towards the other holder and concentric with the common horizontal axis and adapted to be received in the central opening of the disc. A rotatable forming roller is rotatable on an axis substantially parallel with the axis of rotation of the holding members and movable in a direction substantially at right angles to the horizontal axis of rotation of the holding members and into contact with the outer periphery of the disc. The portion of the forming roller which contacts the disc has a convex shape corresponding to the size and shape of the groove to be produced. This convex portion will contact the outer periphery of the disc at a position substantially equidistant from the flat side portions of the disc. Means are provided for rotating the rotatable holding members with the disc supported therebetween. Means are also provided for heating the flat side portions of the disc adjacent to the periphery. Means are also provided for urging the forming roller continuously against the periphery of the disc during the heating thereof until the roller forms the groove in the periphery of the disc. A pair of side rollers are also provided for contacting the rim portion of the groove as it is formed by the forming roller. These side rollers perform a finishing effect on the rim portion of the groove. An additional feature of the invention includes a rim width forming roller which is substantially cylindrical except for a pair of annular depressions corresponding to the locations of the rim portions of the groove. This rim width forming roller will bear against the sheave so that the rim portions of the groove will be received in the annular depressions. Thus, this rim width forming roller will determine the separation and shape of the rim portions and also the ultimate outer diameter of the sheave. A still further feature of the invention involves the provision of a starting roller which contacts the periphery of the disc in advance of the forming roller. The starting roller may have the same convex shape as that of the forming roller, or it could have a flatter or narrower convex shape, depending upon the requirements of the given sheave to be formed.

DESCRIPTION OF THE PREFERRED EMBODIMENTS

Figure 1:
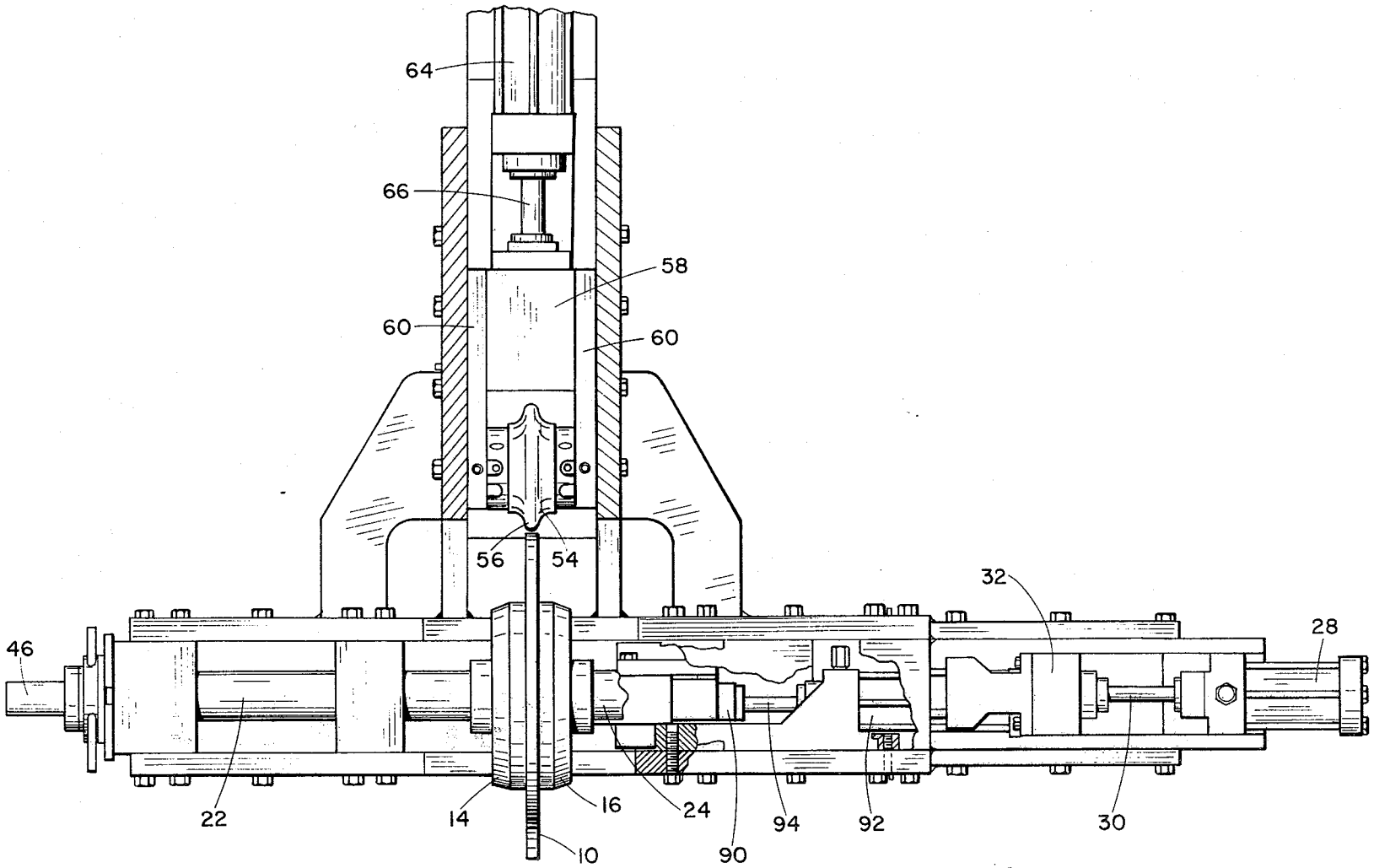
FIG. 1 is a plan view of a machine for forming sheaves in accordance with the present invention showing certain parts of the machine in section and certain parts broken away for purposes of illustration; this view is also taken along broken section line 1—1 of FIG. 3.
Figure 2:
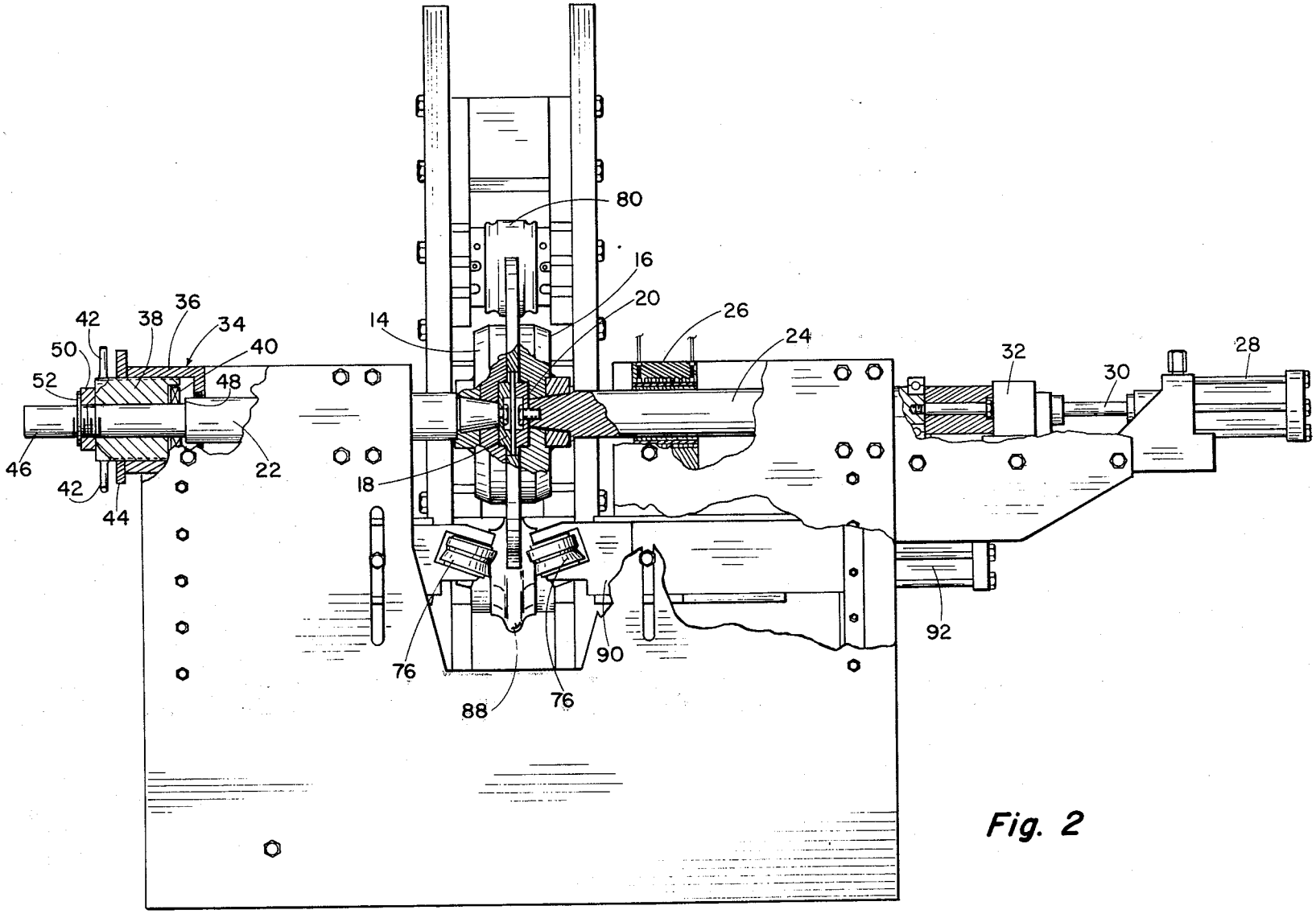
FIG. 2 is a front elevation, with certain parts broken away, of the machine shown in FIG. 1.
Figure 4:
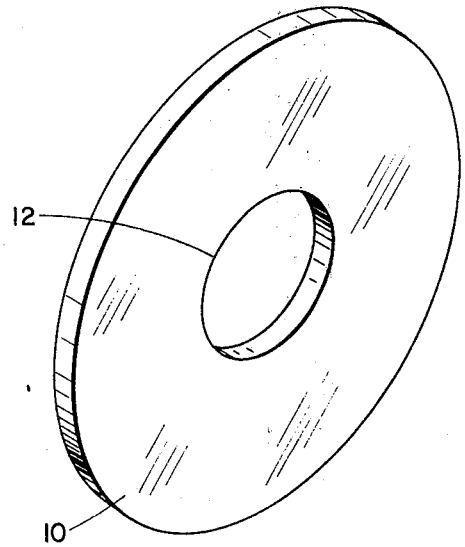
FIG. 4 is a view in perspective of the flat disc or blank of metal from which the sheave of the present invention is made.

Referring to the drawings in detail, the initial starting product from which the ultimate sheave is produced in accordance with the present invention is a flat disc or blank 10 of metal, such as plate steel, having two flat side surfaces or portions separated from each other by the thickness of the disc and having a central hole or opening 12 therein, as best shown in FIG. 4. The disc 10 is adapted to be engaged between a pair of rotatable holders 14 and 16 having opposed hub portions 18 and 20 thereon, respectively, adapted to fit into the hole 12 of the disc. As best shown in FIGS. 1 and 2, the rotatable holders 14 engage the disc 10 adjacent the center thereof, leaving a substantial peripheral portion of the disc extending radially outwardly from the holders to permit heating of the flat side portions of the disc adjacent the periphery of the disc, as will be explained hereinafter. The rotatable holder 14 is mounted at the right-hand end of a rotatable shaft 22, and the holder 16 is mounted at the left-hand end of a rotatable shaft 24. The shafts 22 and 24 are rotatably mounted in a plurality of bearings only one of which is shown as bearing 26; these bearings, such as bearing 26, are preferably water cooled. The holder 18 is relatively axially immovable as will hereinafter appear; however, the holder 16 is axially movable towards and away from the holder 14 by virtue of a hydraulic cylinder 28 which is mounted at the right-hand side of the apparatus. A piston rod 30 which projects out of the hydraulic cylinder 28 connects with the right-hand end of the shaft 24 through a connector 32 which includes a suitable thrust bearing (not shown). When the hydraulic cylinder 28 is actuated by applying hydraulic pressure thereto, the piston rod 30 urges the shaft 24 towards the left so as to clamp the disc 10 between the holders 14 and 16 as shown.

At the left-hand end of the shaft 22, there is provided a take-up or thrust bearing unit 34 which includes an outer threaded sleeve or housing in which a threaded bearing retainer is received. A bearing 40 is retained in the bearing retainer 38. Handles 42 are provided on the bearing retainer 38 so as to permit turning of the latter within the sleeve 36. A lock nut 44 is also provided to lock the retainer 38 in position against the sleeve 36 when the desired position of the holder 14 is reached. The left-hand end of the shaft 22 is reduced in size as at 46 and meets with the main portion of the shaft 22 in a shoulder 48. The shoulder 48 would, therefore, rest against the bearing 40. A take-up nut 50 is threadedly received on a threaded portion of the reduced end 46 of the shaft 22 to reduce end play of the bearing 40 and a tab-lock washer 52 is also provided to lock the take-up nut 50 in position. A variable speed drive (not shown) is connected to the shaft portion 46 to rotate the shaft 22 at any desired speed.

Figure 3:
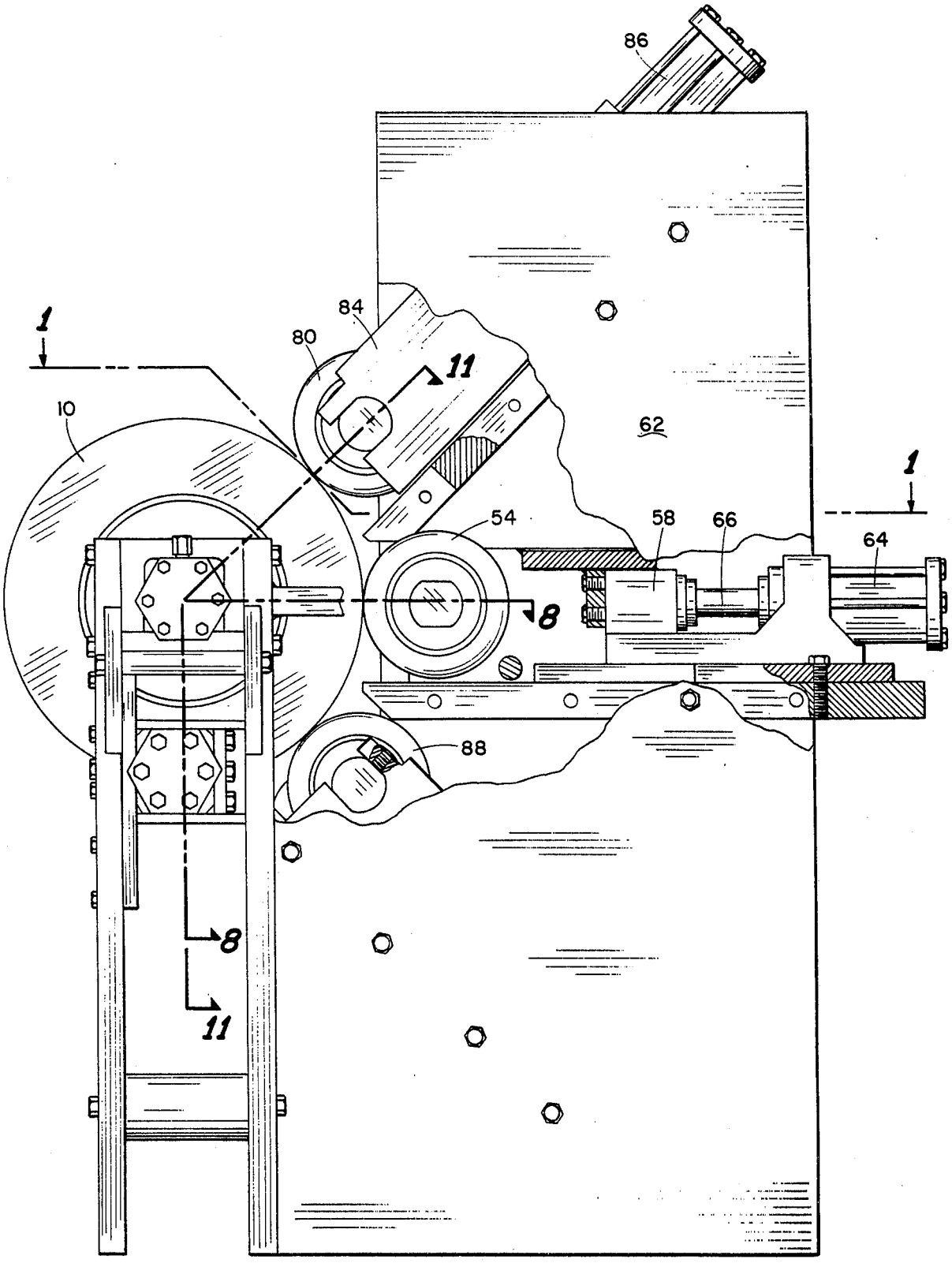
FIG. 3 is a right-hand side elevation, with parts broken away, of the machine shown in FIG. 2.
Figure 5:
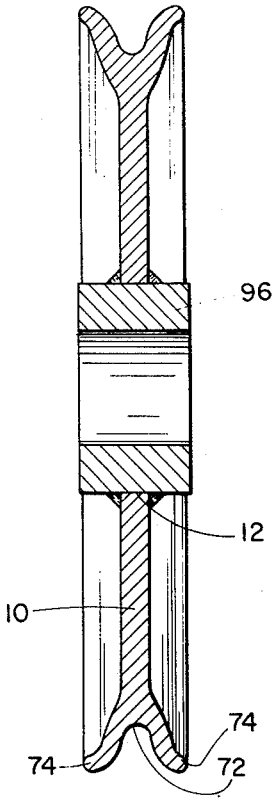
FIG. 5 is a diametral cross-sectional view through a completed sheave made in accordance with the present invention and after attachment of a hub portion.

Turning now to FIGS. 2 and 3, a forming roller 54 is mounted for rotation on a shaft (not shown) substantially parallel to the common longitudinal axis of rotation of the shafts 22 and 24. The outer periphery of the forming roller 54 is provided with a central rounded concave portion 56 which is shaped essentially in the form of the groove in the sheave to be made in accordance with the present invention. The size and shape of the groove will correspond to the diameter of the wire line to be employed with the sheave.

The forming roller 54 is adapted to be brought into engagement with the disc 10 by means of a slide 58 to which is attached a pair of vertical plates 60 in which the shaft (not shown) of the roller 54 is suitably journalled in any conventional manner (not shown). The vertical plates 60 abut against a pair of spaced plates 62 which form the slideway for the plates 60. A hydraulic cylinder 64 is mounted at the ends of the plates 62 and connects with the slide 58 through a piston rod 66. Thus, when the hydraulic cylinder 64 is actuated by introducing hydraulic fluid under pressure thereto, the forming roller 54 is urged against the outer periphery of the plate or disc 10 substantially equidistant between the side flat portions thereof.

Figure 6:
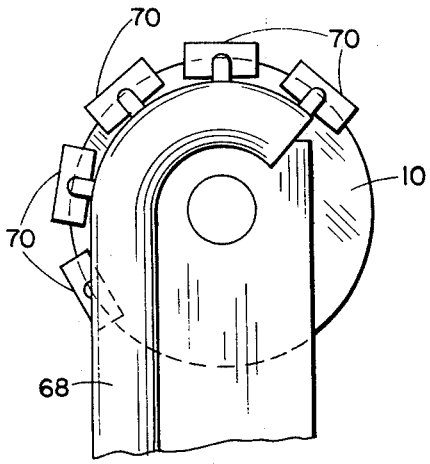
FIG. 6 is a semi-diagrammatic side elevation of a heater arrangement for the production of a smaller sized sheave in accordance with the present invention.

As best shown in FIG. 6 a manifold 68 is mounted on the apparatus adjacent the flat side portions of the disc 10. A plurality of heaters 70, in this case, five, extend outwardly from the manifold 68 and are adapted to project a flame against the flat side portions of the disc 10 adjacent the outer periphery thereof; although FIG. 6 shows only one manifold 68 and one set of heaters 70, it should be understood that another manifold 68 and another set of heaters 70 are positioned on the opposite side of the disc 10 from that shown in FIG. 6 so as to heat the opposite flat side portion of the disc 10 adjacent the periphery thereof. The arrangement of five heaters for the disc 10 in FIG. 6 would be for a relatively smaller diameter disc 10. However, in connection with larger size discs such as disc 10′ as shown in FIG. 7, a larger number of heaters 70 will be required; for the purposes of illustration only, ten such heaters 70 are shown as heating the flat side portion of the disc 10′ adjacent the periphery thereof; again, although only on manifold 68 and one set of heaters 70 are shown in FIG. 7, it should be understood that a similar arrangement would be located on the opposite side of the disc 10′ from that shown in FIG. 7.

Any desired gas or combination of gasses can be burned in the heaters 70 provided they are capable of raising the temperature of the peripheral portion of the disc 10 to a red heat where the metal can be deformed or upset by the forming roller 54. Thus, mixtures of oxygen and acetylene, or other suitable mixtures can be employed in the heaters 70.

Figure 7:
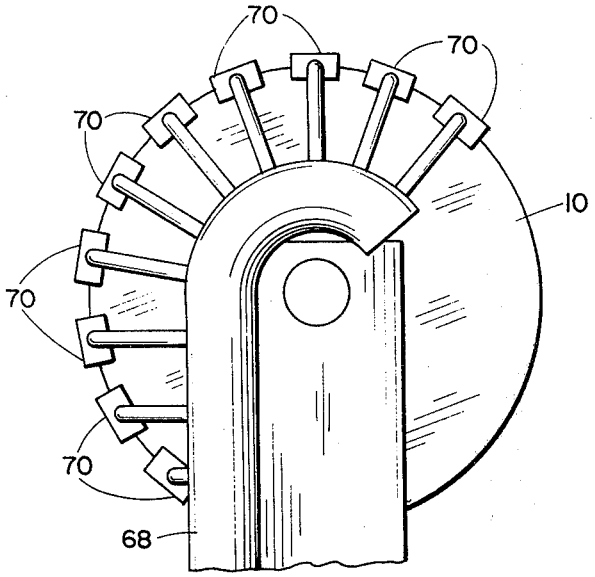
FIG. 7 is a view similar to FIG. 6, but showing a heater arrangement for the production of a larger sized sheave in accordance with the present invention.

It should be understood that the heater arrangement of FIG. 6 or FIG. 7, as described above, would be incorporated into the mechanism shown in FIGS. 1, 2 and 3, depending upon the size of the sheave to be produced; however, neither construction of FIGS. 6 or 7 is shown in FIGS. 1, 2 and 3 so as not to unduly complicate the illustrations in these figures.

The disc 10 is rotated at a speed necessary to produce the desired shape of the groove; varying the speed of rotation of the disc above or below the optimum speed will affect the forming of the groove; however, the operator can visually determine when the groove is being formed properly. The temperature to which the disc 10 is heated will also affect the forming of the groove; so also will the pressure exerted by the roller 54 against the periphery of the disc 10; again, the experienced operator can determine visually when the groove is being formed properly.

Figures 8, 9, 10, 11:
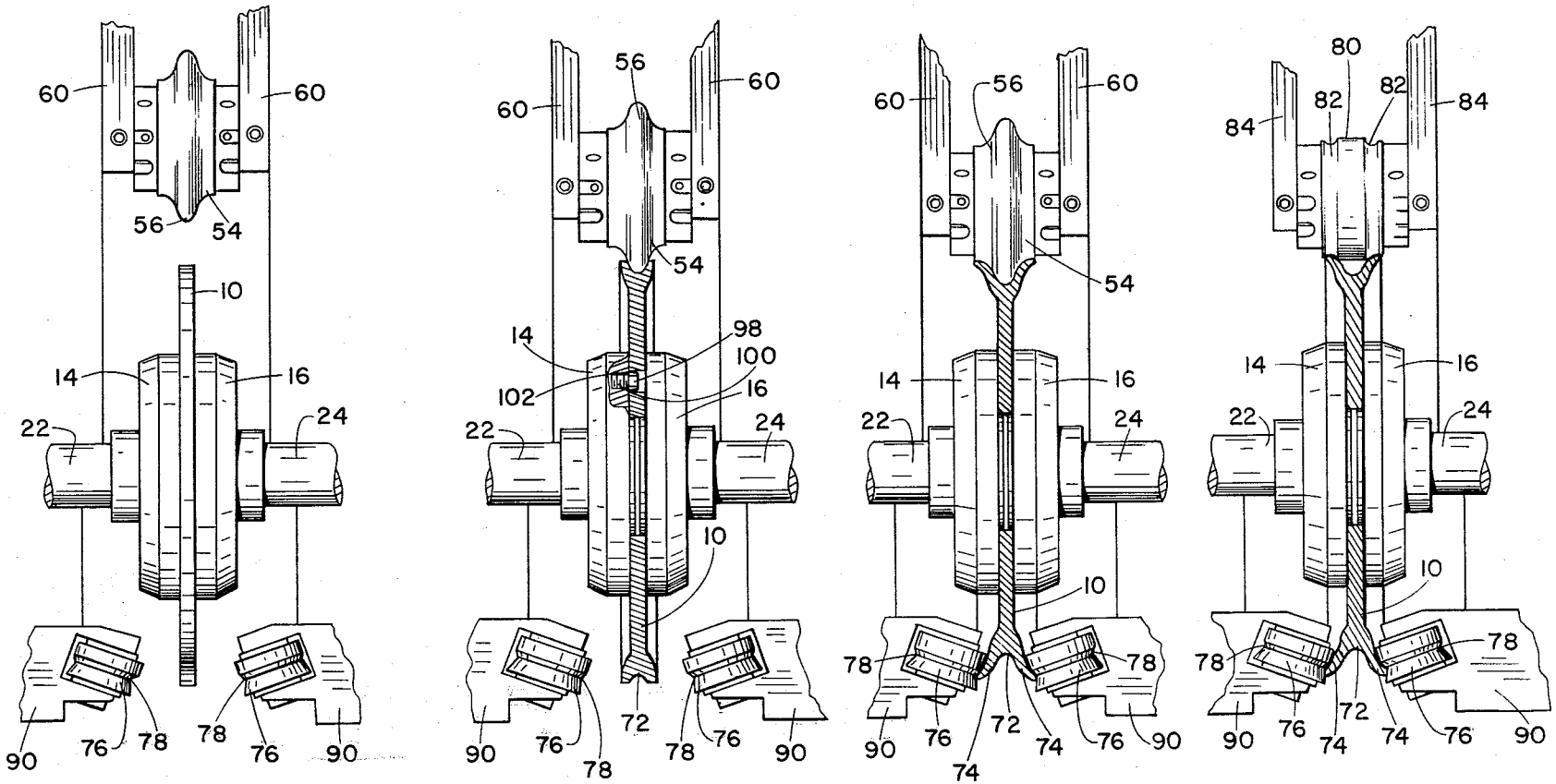
FIGS. 8 to 10, inclusive, are semi-diagrammatic views showing the progress of the formation of a sheave through successive stages of the operation of the apparatus of the present invention and viewed essentially along section line 8—8 of FIG. 3.
FIG. 11 is a view similar to FIGS. 8 to 10, inclusive, showing one of the final stages of the operation of the apparatus of the present invention and taken along section line 11—11 of FIG. 3.

Turning now to a consideration of FIGS. 8, 9 and 10, these figures show the successive operations of the forming roller 54 with respect to the disc 10. Thus, in FIG. 8, the forming roller 54 is spaced away from the disc 10; at this point in time, the disc 10 would be undergoing the heating action of the burners 70 to heat the disc until the proper red temperature is reached. When the outer peripheral portion of the disc 10 is heated to the proper temperature, the forming roller 54 is moved towards and into engagement with the periphery of the disc 10 so as to commence to form a groove 72 as shown in FIG. 9. Continued rotation of the disc 10 with continued heating and continued application of force of the roller 54 will cause the groove 72 to become more completely formed as shown in FIG. 10. This figure clearly shows the outer rim portions 74 of the groove 72.

Although not previously described, FIGS. 8 through 10 show a pair of side rollers 76 each of which is provided with a central angled annular recess 78. Although the use of these side rollers 76 is considered optional, nevertheless it is believed that they assist in the proper formation of the groove 72 and the rim portions 74. Sometimes it is desirable to bring the rollers 76 closer together to provide, temporarily, a narrower rim width and then back them off to the final rim width to achieve the proper shaping of the groove 72. The rollers 76 are suitably journalled at the ends of slides 90. Each slide 90 (see FIGS. 1 and 2) is moved towards and away from the center of the apparatus by means of a hydraulic cylinder 92 which connects with the slide 90 through a piston rod 94.

As shown in FIG. 11, it may be desirable, in the connection with the formation of some sheaves, to provide an additional roller 80 which serves as a rim width forming roller and which would also determine the ultimate outer diameter of the rim portions 74. At any event, the rim forming roller 80 is essentially in the form of a flat cylinder having two annular depressions 82 therein corresponding to the locations of the rim portions 74. The final rim width forming roller 80 is suitably journalled (in a manner not shown) in a pair of plates 84 which are slidable in a suitable way (not shown) between the side plates 62 in substantially the same manner as described previously in connection with the vertical plates 60. The vertical plates 84 are connected to a slide member (not shown) substantially the equivalent of slide member 58 previously described and the slide for the roller 80 is actuated by a hydraulic cylinder 86 which connects with the slide (not shown) for the roller 80 through a piston rod (not shown) which is substantially the equivalent of the piston rod 66 previously described.

As best shown in FIGS. 2 and 3, there is shown a starting roller 88 which is utilized in conjunction with the forming roller 54. This starting roller is adapted to contact the periphery of the disc 10 in advance of the roller 54. The roller 88 can be shaped similar to the roller 54 or it could have a flatter or more pointed shape, depending upon the requirements of the given situation. The roller 88 is actuated in the same manner as the roller 54 through substantially identical means (not shown).

After the final operations have been completed on the disc 10, such as shown in FIG. 11, the various forming rollers are retracted, the holders 14 and 16 are separated, and the now hot sheave is removed and allowed to cool. After cooling, a hub portion 96 is suitably secured to the disc 10 within the opening 12 by welding or other suitable means.

In connection with larger size discs, it may be desirable to provide a driver in the form of a screw 98 to prevent the disc from slipping. The screw 98 is threaded into a suitable hole 100 in the holder 14 and is received in a small hole 102 in the disc 10. After the completion of the operation shown in FIG. 11, the hole 102 can be readily filled in if deemed necessary.

TYPICAL OPERATION

The method of the present invention may be more readily understood in connection with the following description of a typical operation using the apparatus disclosed herein.

A 20 inch diameter sheave for handling a ¾ inch diameter wire line was produced from a 20½ inch diameter disc of metal, approximately ¾ inch thick as follows. The disc 10 was cut from a piece of plate steel with a torch and was provided with a central opening 12 of approximately 6 inches in diameter. The plate 10 was then placed between the holders 14 and 16 and the latter were rotated at a speed of approximately 50 revolutions per minute. The heaters 70 were provided with a mixture of air and natural gas and ignited and the disc 10 was continued rotating until a red temperature was reached (approximately 1600° F.). At this time, the forming roller 54 was moved into contact with the outer periphery of the disc 10. The outer diameter of the roller 54 was approximately 8 inches with the hydraulic cylinder 64 having an internal diameter of about 2¾ inches. The pressure on the hydraulic cylinder 64 was started at approximately 700 p.s.i. and brought up gradually to about 1500 p.s.i. until the rim portions 74 were clearly evident. At this point the side rollers 76 were urged against the rim portions 74 until a properly formed rim 74 was completed. Because the sheave produced above was a relatively small sheave, the rim-width forming roller 80 was not employed nor was the starting roller 88. After a total heating and forming time of approximately 12 minutes, the burners 70 were extinguished, the various rollers retracted, the holders were opened and the hot blank was removed from the apparatus and allowed to cool. The outer diameter of the resulting sheave was 19⅞ inches, the bottom of the groove 72 corresponded to a diameter of ¾ inches to accommodate the wire rope of that size. The maximum rim width was approximately 2¼ inches and the depth of the recess 72 was approximately 1⅛ inches.

Obviously, the formation of different size sheaves adapted to accommodate different sizes of wire lines may require a change in some of the conditions described above; for example, it may be necessary to vary the speed of rotation, the temperature, the pressure and the heating and forming time.

Whereas the present invention has been described in particular relation to the drawings attached hereto and the method of operation of the apparatus disclosed therein, it should be understood that other and further modifications, apart from those shown or suggested herein, may be made within the spirit and scope of this invention. For example, the disc 10 need not necessarily be provided with the central opening 12 to engage the hub portions 18 and 20 on the holders; it would be possible to provide the disc 10 with a plurality of small holes (not shown) such as the small hole 102 which would be adapted to engage a plurality of drivers (not shown) similar to the driver 98 which would be received in the holder 14. Also, it might be desirable to weld the hub 96 to the disc 10 prior to the formation of the groove therein, in which case the disc 10 would be supported between the holders 14 and 16 with the sides of the hub portion 96 being received in suitable openings or recesses (not shown) in the holders 14 and 16, respectively. Other ways might also be provided for securely holding the disc 10 between the holders 14 and 16.

I claim:

1. Apparatus for forming a flat circular disc of metal into a sheave having an annular peripheral groove for receiving a wire line therein, the size and shape of said groove corresponding to the diameter of said wire line, said disc having two flat side portions separated by the width of said disc and having an outer diameter slightly larger than the outer diameter of the sheave to be produced; comprising a pair of rotatable holding members for engaging said disc therebetween, said rotatable holding members engaging said disc adjacent the center thereof with the periphery of said disc extending outwardly beyond said holding members, means for rotating said holders and said disc about a given horizontal axis, a rotatable forming roller rotatable on an axis substantially parallel with said given horizontal axis and movable in a direction substantially at right angles to said given horizontal axis and into contact with the outer periphery of said disc, the portion of said forming roller contacting said disc having a convex shape corresponding to the size and shape of the groove desired for the wire line and contacting said disc on the outer periphery thereof at a position substantially equidistant from the flat side portions of said disc, means for heating the flat side portions of said disc adjacent said periphery, means for urging said roller continuously against said periphery of said disc during the heating thereof until said roller forms said groove in the periphery of said disc.

2. Apparatus for forming a flat circular disc of metal into a sheave as set forth in claim 1 wherein said flat circular disc of metal has a central opening therein and wherein each holder has a hub portion facing towards the other holder concentric with said given horizontal axis, said hub portions being received in said central opening of said disc when said disc is engaged between said holders.

3. Apparatus for forming a flat circular disc of metal into a sheave as set forth in claim 1 including a pair of side rollers movable towards and away from each other and towards and away from the sides of said disc for engaging the lateral sides of the periphery of said disc after said forming roller has formed said groove in the periphery of said disc.

4. Apparatus for forming a flat circular disc of metal into a sheave as set forth in claim 3 including a rim-width forming roller rotatable on an axis substantially parallel to said given horizontal axis, said rim-width forming roller being substantially cylindrical except for a pair of spaced rim-engaging annular depressions therein, means for moving said rim-width forming roller substantially at right angles to said given horizontal axis towards said disc for engaging the outer peripheral edges of said disc after said groove has been formed therein by said forming roller to determine the rim width of said groove and the final outer diameter of the so-manufactured sheave.

5. Apparatus for forming a flat circular disc of metal into a sheave as set forth in claim 4 including a starting roller rotatable on an axis substantially parallel to said given axis and movable in a direction substantially at right angles to said given axis and into contact with the outer periphery of said disc in advance of the contact therewith by said forming roller.

6. Apparatus for forming a flat circular disc of metal into a sheave as set forth in claim 1 including a rim-width forming roller rotatable on an axis substantially parallel to said given horizontal axis, said rim-width forming roller being substantially cylindrical except for a pair of spaced rim-engaging annular depressions therein, means for moving said rim-width forming roller substantially at right angles to said given horizontal axis towards said disc for engaging the outer peripheral edges of said disc after said groove has been formed therein by said forming roller to determine the rim width of said groove and the final outer diameter of the so-manufactured sheave.

7. Apparatus for forming a flat circular disc of metal into a sheave as set forth in claim 1 including a starting roller rotatable on an axis substantially parallel to said given axis and movable in a direction substantially at right angles to said given axis and into contact with the outer periphery of said disc in advance of the contact therewith by said forming roller.

8. A method of forming a sheave from a flat circular disc of metal, said sheave being of the type having an annular peripheral groove for receiving a wire line therein, the size and shape of said groove corresponding to the diameter of said wire line, said disc having two flat side portions separated by the width of said disc and having an outer diameter slightly larger than the outer diameter of the sheave to be produced; comprising the steps of engaging said disc between a pair of rotatable holding members, said rotatable members engaging said disc adjacent the center thereof with the periphery of said disc extending outwardly beyond said holding members, rotating said holding members and said disc about a given horizontal axis coaxial with the central axis of said disc, contacting the outer periphery of said disc with a rotatable forming roller rotatable on an axis substantially parallel with said common horizontal axis and movable in a direction substantially at right angles to said given horizontal axis, the portion of said forming roller contacting said disc having a convex shape corresponding to the size and shape of said groove and contacting said outer periphery at a position substantially equidistant from the flat side portions of said disc, heating the flat side portions of said disc adjacent said periphery, and urging said roller continuously against said periphery of said disc during the heating thereof until said roller forms said groove in the periphery of said disc.

9. A method of forming a sheave from a flat circular disc of metal as set forth in claim 8 including steps of contacting the lateral side edges of the periphery of said disc after the formation of said groove therein by said forming roller with a pair of side rollers movable towards and away from each other and towards and away from the sides of said disc for assisting in the formation of the completed groove in the periphery of said disc.

10. A method of forming a sheave from a flat circular disc of metal as set forth in claim 9 including the step of contacting the outer periphery of said disc after the formation of said groove therein by said forming roller with a rim-width forming roller rotatable on an axis substantially parallel with said common axis and movable in a direction perpendicular to said common axis, said rim-width forming roller being substantially cylindrical except for a pair of spaced apart rim-engaging annular depressions therein, said rim-width forming roller engaging the periphery of said disc so that the outer periphery thereof is received in said rim-engaging depressions.

* * * * *